United States Patent [19]

Mabus

[11] 3,975,822

[45] Aug. 24, 1976

[54] NEEDLEPOINT AND CREWEL-EMBROIDERY STITCH REMOVER

[76] Inventor: Richard C. Mabus, 46 Mary Drive, Towaco, N.J. 07082

[22] Filed: May 28, 1975

[21] Appl. No.: 581,582

[52] U.S. Cl. ..... 30/294

[51] Int. Cl.[2] ..... B26B 29/00

[58] Field of Search ..... 30/294, 314, DIG. 8

[56] References Cited

UNITED STATES PATENTS

| | | | |
|---|---|---|---|
| 604,675 | 5/1898 | Fisher | 30/294 |
| 2,764,814 | 10/1956 | Jecker | 30/294 |
| 3,100,935 | 8/1963 | Leafe | 30/294 |

*Primary Examiner*—Al Lawrence Smith
*Assistant Examiner*—J. C. Peters
*Attorney, Agent, or Firm*—Jack Matalon

[57] ABSTRACT

A needlepoint and crewel-embroidery stitch remover having a handle secured to a member. The member terminates in a bifurcation with a long tine and a short tine with a cutting surface in the crotch between the tines.

4 Claims, 3 Drawing Figures

NEEDLEPOINT AND CREWEL-EMBROIDERY STITCH REMOVER

This invention relates to a needlepoint and crewel-embroidery stitch remover. This invention is, in relationship to seam rippers, a considerable improvement, when utilized for removing stitches from needlepoint and crewel fabrics. Ordinary seam rippers are designed with cutting surfaces on the inner surface of their long tines. Such seam rippers are not, however, fully adaptable for use in removing needlepoint and crewel-embroidery stitches since their cutting surfaces frequently result in a cutting of the underlying fabric. Furthermore, the use of ordinary seam rippers for such purposes is disadvantageous since stitch removal proceeds very slowly if cutting of the fabric is to be avoided.

In contrast to seam rippers, this invention permits rapid removal of needlepoint and crewel-embroidery stitches with very little risk of cutting the underlying fabric.

In its broadest sense, this invention comprises a needlepoint and crewel-embroidery stitch remover having a handle secured at one end to a member, said member terminating at its other end, in a bifurcation including a long tine and a short tine with a crotch thereinbetween, said crotch containing a tapered surface terminating in a cutting edge, said tapered surface extending from a mid-point of the crotch substantially to the end of the short tine and also extending substantially the same length to a pre-determined point on the inner surface of the long tine, said long tine having an elongated portion extending beyond said point.

Preferably, the tapered surface is concave; especially preferred are opposed concave surfaces. To guard against accidental cutting of the underlying fabric, it is desirable that the surface containing the cutting edge extend only to a pre-determined point on the long tine. The location of this pre-determined point is not critical; it is only necessary that there be sufficient length of the long tine projecting beyond such pre-determined point to allow the long tine to be fully inserted under the stitch (and on top of the underlying fabric) prior to urging the cutting edge against the stitch.

Most usefully, the elongated portion of the long tine extending beyond the pre-determined point will have a configuration substantially identical to that of a number 20 tapestry needle. To lessen the risk of tearing the underlying fabric, it is desirable that both the short tine and long tine terminate in blunted points.

The materials for the handle are traditional, e.g. wood, thermosetting or thermoplastic polymers, aluminum, etc. The stitch-removing member may consist of materials that are able to hold a cutting edge, e.g. stainless steel, tool steel chrome alloy, etc. The handle may be rectangular, hexagonal, octagonal, oval, round (preferred), etc.; it may be solid or hollow and the member may be affixed to the handle by conventional means, e.g. molding, bolting, glueing, etc.

In a typical case, the length of the member from the point of emergence from the handle to the tip of the long tine will vary from about ¾ to 1½ inch, preferably 1 to 1¼ inch. The elongated portion of the long tine, extending beyond the pre-determined point, may vary from about ⅜ to ¾ inch, preferably ½ to ⅝ inch. The length of the short tine from the mid-point of the crotch to the tip may vary from about ⅛ to about ½ inch, preferably ¼ to ⅜ inch.

When the elongated portion of the long tine has a configuration substantially identical to that of a number 20 tapestry needle, such portion will be tapered, i.e. it will vary from a diameter of about 0.025 inch at its tip (which is preferably rounded off to present a blunt surface) to about 0.045 inch at its base (i.e. at the pre-determined point).

The thickness of the member is not critical, i.e. it may vary from about 1/32 to 1/16 inch.

This invention may be understood with reference to the accompanying drawings in which.

Figure 1:
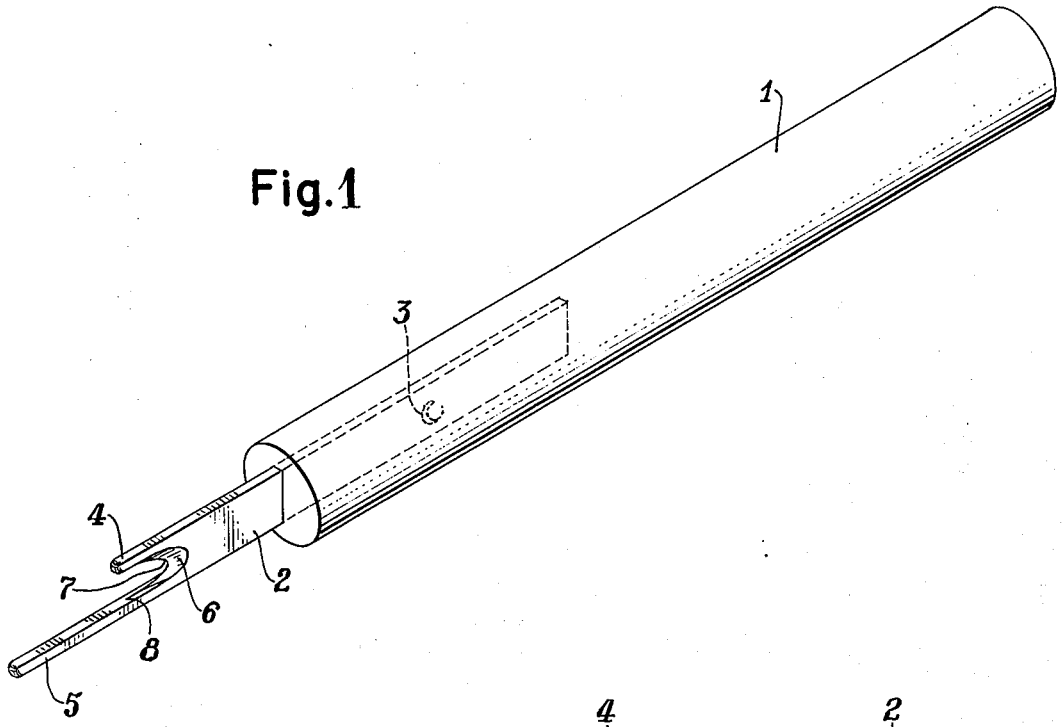
FIG. 1 is a perspective view.
Figure 2:
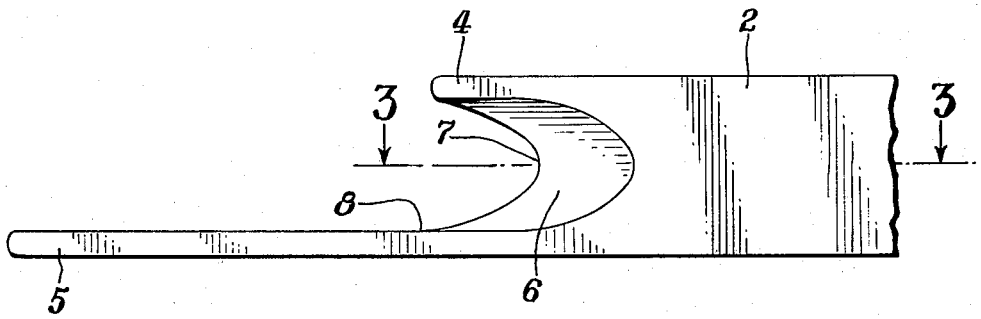
FIG. 2 is an elevation view.
Figure 3:
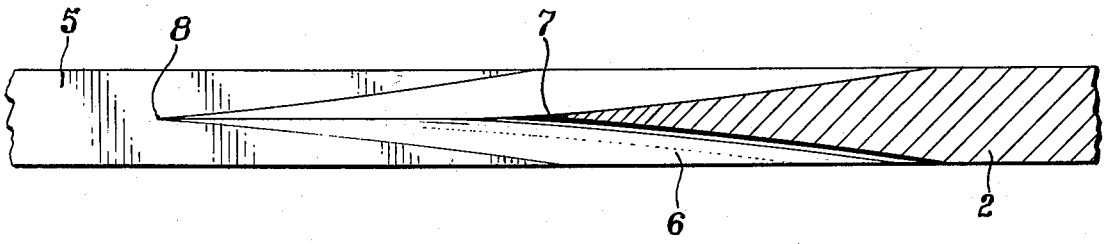
FIG. 3 is an enlarged cross-sectional view taken along the lines 3—3 of FIG. 2.

Referring in detail to the drawings (in which like numbers refer to the same features), 1 is the handle which receives stitch-removing member 2. Stitch-removing member 2 conveniently contains a tang 3 (such as that formed by partially punching out a circular projection or lip) which insures that member 2 is not readily removable from handle 1 (typically, handle 1 is round in shape and member 2 is inserted about 1 to about 2 inches into handle 1).

Member 2 terminates at its opposite end in a bifurcation in the form of short tine 4, long tine 5 and crotch 6 thereinbetween. Crotch 6 preferably contains one or opposed tapered surfaces (preferably the taper is concave) and should terminate in cutting edge 7. Crotch 6 will generally extend from approximately the tip of short tine 4 to pre-determined point 8 on the inner surface of long tine 5. Point 8 is preferably located directly opposite the tip of short tine 4, i.e. crotch 6 will preferably extend equal distances, from its mid-point, along the inner surfaces of tines 4 and 5, substantially to the tip of tine 4 and to point 8 on tine 5. It is necessary that there be an elongated portion of tine 5 projecting beyond point 8 and that the cutting edge not extend beyond point 8. This will allow the elongated portion to be inserted under the stitch to be removed and thereafter pushing the elongated portion such that the inner surface is under the stitch and the outer (or opposite surface) is on top of the underlying fabric until the stitch is urged against the cutting edge. The cut stitch is then readily removable from the fabric without any tearing or cutting of the latter.

I claim:

1. A needlepoint and crewel embroidery stitch remover having a handle secured at one end to a member, said member terminating at its other end, in a bifurcation including a long tine and a short tine with a crotch thereinbetween, said long tine and said short tine terminating in blunted points, said crotch containing a tapered surface terminating in a cutting edge, said tapered surface extending from a mid-point of the crotch substantially to the end of the short tine and also extending substantially the same length only to a pre-determined point on the inner surface of the long tine, said long tine having an elongated portion extending beyond said point a distance of about ⅜ inch to ¾ inch.

2. The stitch remover of claim 1 wherein the tapered surface is concave.

3. The stitch remover of claim 2 wherein there are opposed concave tapered surfaces.

4. The stitch remover of claim 1 wherein the elongated portion of the long tine has a configuration substantially identical to that of a number 20 tapestry needle.

* * * * *